US006006057A

United States Patent [19]

Snelling

[11] Patent Number: 6,006,057

[45] Date of Patent: Dec. 21, 1999

[54] PIEZOELECTRIC IMAGING PROCESS

[75] Inventor: Christopher Snelling, East Rochester, N.Y.

[73] Assignee: Xerox Corporation, Stamford, Conn.

[21] Appl. No.: 09/219,732

[22] Filed: Dec. 22, 1998

[51] Int. Cl.[6] ..... G03G 15/00

[52] U.S. Cl. ..... 399/162; 430/126

[58] Field of Search ..... 399/162, 159, 399/302, 303, 308; 430/48, 56, 126

[56] References Cited

U.S. PATENT DOCUMENTS 4,106,933 8/1978 Taylor ..... 430/47

5,610,795 3/1997 Snelling ..... 399/162 X 5,671,472 9/1997 Snelling ..... 399/308

*Primary Examiner*—William Royer

*Assistant Examiner*—Hoan Tran

[57] ABSTRACT

A piezographic imaging process includes the use of a composite photoreceptor structure that includes a piezoactive layer that enables Xerographic imaging without corona charge/transfer subsystems. Flexure of the photoreceptor structure creates electric fields sufficient for the creation of developable latent electrostatic image patterns. Flexure of the photoreceptor structure following development generates an electric field for transfer of toner images onto paper.

2 Claims, 4 Drawing Sheets

PIEZOELECTRIC IMAGING PROCESS

BACKGROUND OF THE INVENTION

The present invention relates generally to an imaging process for placing images onto copy sheets, and more particularly, to an imaging process that employs the piezoelectric effect to achieve charging and transfer.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate, to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

The generation of ozone by corona charging and transfer units in these systems is of increasing concern as emphasis on environment impacts grow. Also, the elimination of high voltage power supplies contributes significantly to reduction of system unit manufacturing costs.

PRIOR ART

Heretofore, polyvinylidene fluoride (PVFD) film and other materials have been known to exhibit piezoelectric effect. For example, piezoelectric materials are formed by stretching PVFD film in one direction, applying a large electric field to electrically polarize it in a direction perpendicular to the film. As shown in FIG. 1., the stretch direction is denoted by "1" and the polarization direction is noted by "3". When a PVFD sheet is strained, it envelops an internal electric field, which is proportional to the deformation.

The present invention utilizes a unimorph structure referred to as a "Xeromorph". The unimorph Xeromorph consists of one PVDF layer such that bending the structure causes the PVDF sheet to stretch or compress. A bimorph structure is also referred to as a "Xeromorph". A bimorph Xeromorph consists of two PVDF sheets 6 laminated together with each sheet polarization in directions opposed to each other having only a bottom electrode 7 as shown in FIG. 2. A radiation sensitive piezoelectric copy method and medium for producing positive or negative latent electrostatic charge patterns is disclosed in U.S. Pat. No. 4,106,933 to Allen L. Taylor. In one embodiment, a copy medium includes a poled, radiation transmissive piezoelectric insulative layer, an electrically conductive layers less compliant than the piezoelectric layer, and a photoconductive layer interposed between and electrically connected with the piezoelectric and electrically conductive layers. There is still a need for an imaging process that is environmentally friendly and low cost.

SUMMARY OF THE INVENTION

Accordingly, a piezoelectric imaging process and apparatus is disclosed which includes a composite photoreceptor structure that comprises a piezoelectric layer that enables xerographic imaging without corona charge/transfer subsystems. Flexure of the photoreceptor structure creates electric fields appropriate for the creation of developable latent electrostatic image patterns. Flexure of the photoreceptor structure following development generates an electric field for transfer of the toner image onto paper.

BRIEF DESCRIPTION OF THE DRAWINGS

The foregoing and other features of the instant invention will be apparent from a further reading of the specification, claims and from drawings in which:

While the present invention will be described hereinafter in connection with a preferred embodiment thereof, it should be understood that it is not intended to limit that invention to that embodiment. On the contrary, it is intended to cover all alternatives,; modifications and equivalents as may be included within the spirit and scope of the invention as defined by the appended claims.

DETAILED DESCRIPTION OF THE PREFERRED EMBODIMENT

The invention will now be described by reference to a preferred embodiment of an imaging process involving piezography. Piezography utilizes flexure of a piezoactive photoreceptor structure to create an electric field across a photoreceptor layer prior to exposure and again to create a field to transfer developed toner to paper.

Figure 1:
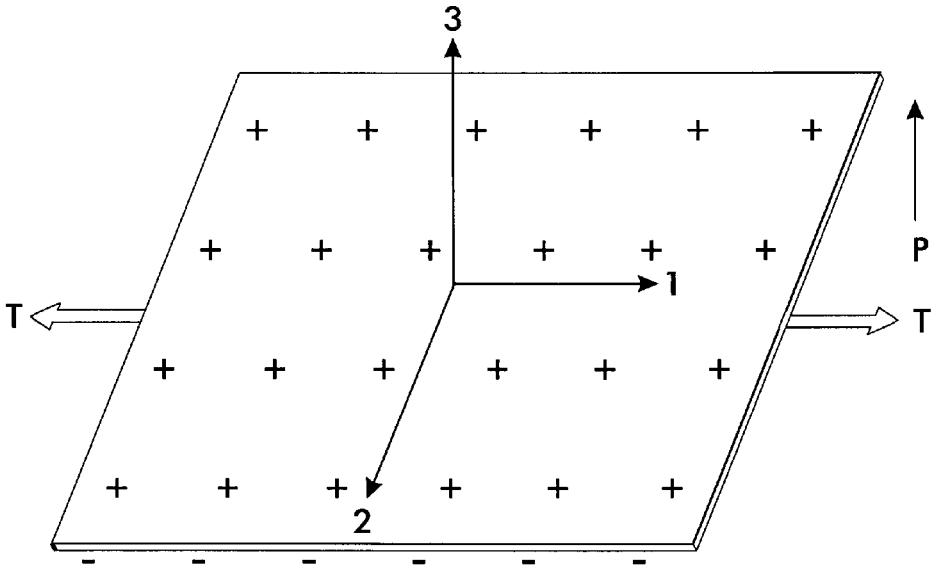
FIG. 1 PRIOR ART
FIG. 1 is a perspective view illustrating the geometry of a prior art piezoelectric sheet.
Figure 2:
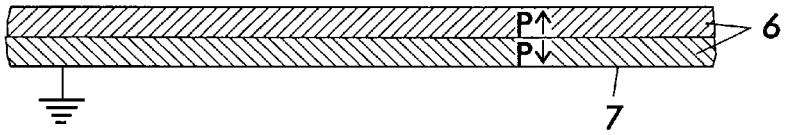
FIG. 2 PRIOR ART
FIG. 2 is an elevational view illustrating a prior art (bimorph) Xeromorph sheet which is utilized in the present invention.
Figure 3:
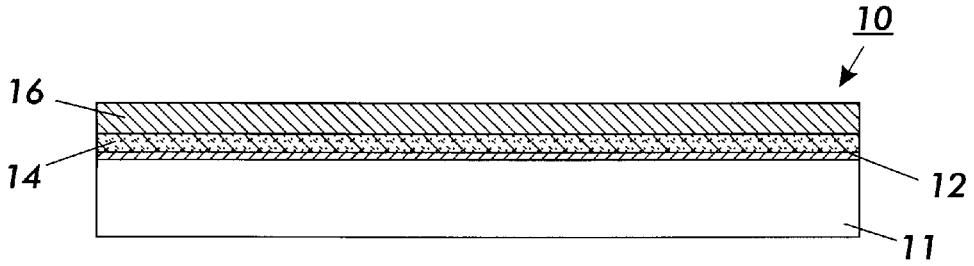
FIG. 3 is an elevational view illustrating the piezoactive photoreceptor structure of the present invention.

For a general understanding of the features of the present invention, reference is made to the drawings. In the drawings, like reference numbers have been used throughout to designate identical elements. With reference to FIG. 3, a piezoactive photoreceptor structure 10 is shown that comprises a support layer 11. An electrode 12 is positioned on a top surface of support layer 11 with a piezoelectric film 14 situated on top of electrode 12. A photoconductive member 16 completes the piezoactive photoreceptor structure 10.

Figure 4:
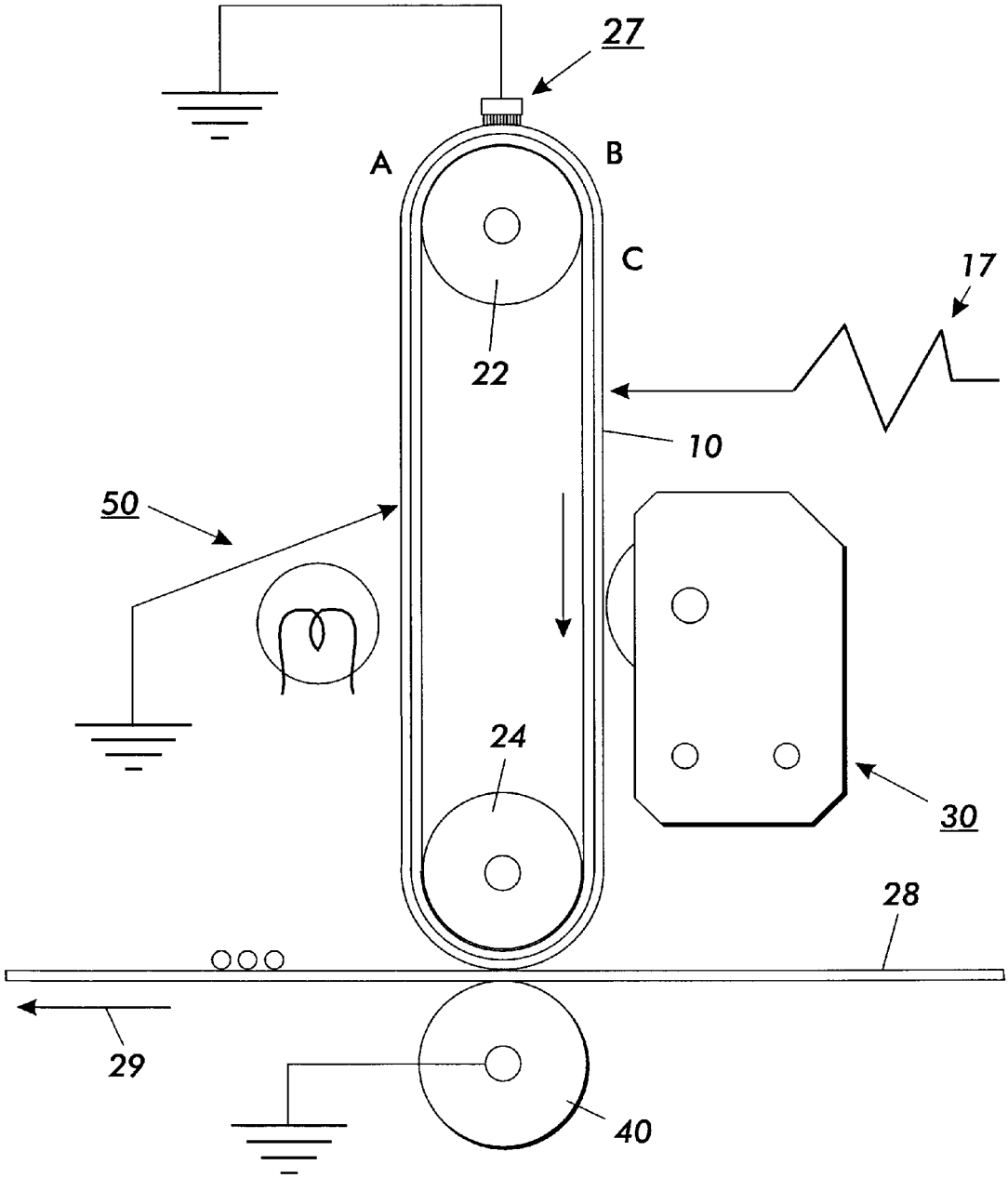
FIG. 4 is an elevational view illustrating an imaging apparatus employing the piezoactive photoreceptor structure of the present invention.
Figure 5:
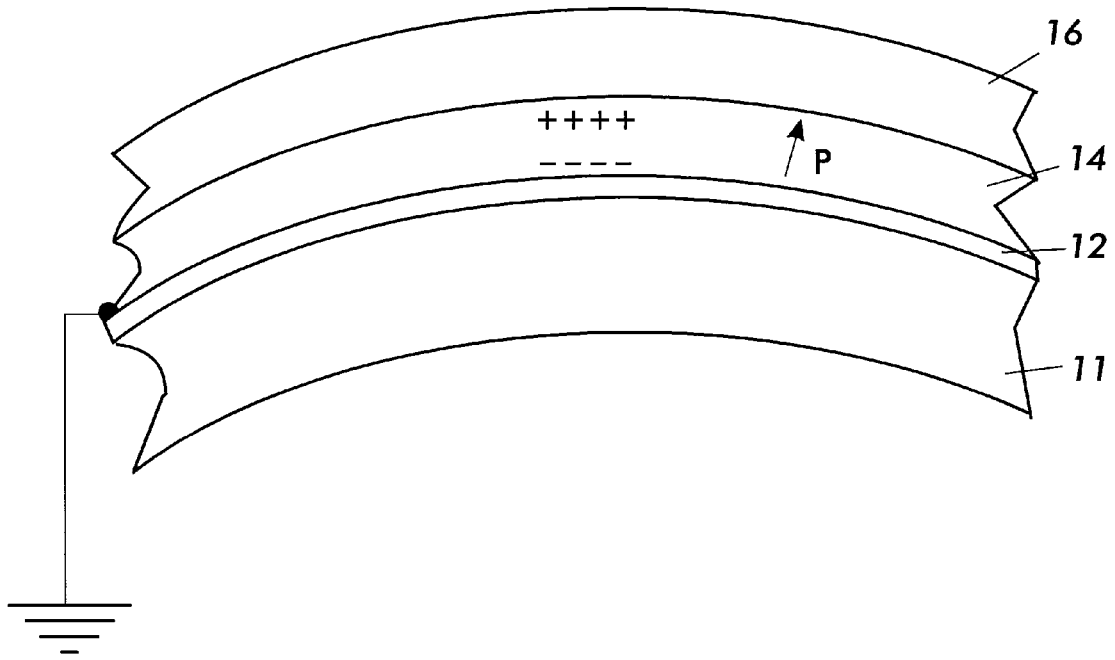
FIG. 5 is an elevational view showing the Xeromorph effect of the piezoactive photoreceptor structure of FIG. 3.
Figure 6A:
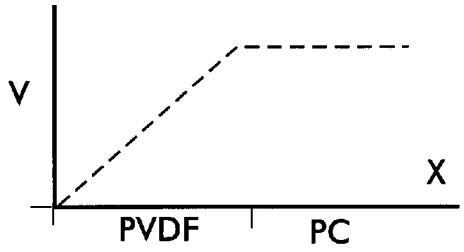
FIG. 6 is an elevational view of an imaging apparatus employing the piezoactive photoreceptor structure of the present invention.
Figure 6B:
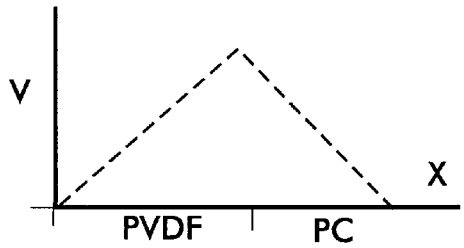
Figure 6C:
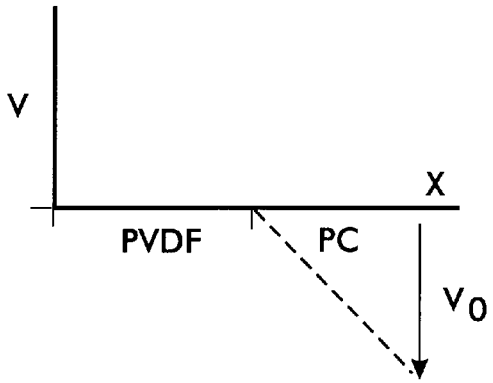

An ozone reducing apparatus is shown in FIG. 4 that includes piezoactive photoreceptor structure 10 in the form of a belt entrained around drive roll 22 and idler roll 24. The belt is rotated by drive roll 22 in a clockwise direction. The belt is self-biased by bending it around drive roll 22 and idler roll 24. This self-biasing is based upon the piezoelectric effect in the flexible Xeromorph layer that is polarized in the direction of arrow P as shown in FIG. 5. The direction and degree of curvature determines the instantaneous polarity and magnitude of surface charge on the top of the piezoelectric layer 14. Grounding of the top surface creates an electric field across the photoconductive layer 16. As a result, the piezoelectric effect is utilized to achieve ozone free charging and transfer of images from the belt to copy sheets 28 without the need for a power supply. Piezoactive belt 10 generates a positive potential when bent around the curved surface of drive roll 22 and idler roll 24 as shown in FIG. 6A. As shown in FIG. 6B, the surface potential is neutralized by a grounded brush 27 as the belt continues to rotate around drive roll 22. In FIG. 6C the potential of the top surface of the piezoactive member becomes a negative potential upon mechanically relaxing the piezoelectric film in the flat zone relative to the drive roll strain state. The Xeromorph effect of the piezoactive photoreceptor structure 10 is shown in FIG. 5 as it is bent around drive roll 22 with net positive charge generated on the top surface of PVFD material 14 while simultaneously net negative charge is generated on the bottom surface of the PVFD material.

At 17, page image information is projected onto belt 10 by use of, for example, a raster output scanner (ROS). The image is then developed on discharged areas at 30 and transferred to copy sheet 28 utilizing the positive voltage created by the belt 10 bending around idler roll 24. To repel toner toward the paper copy sheets, a grounded roll 40 is positioned adjacent belt 10 opposite idler roll 24 and forms a nip with belt 10 to transport copy sheet 28 in the direction of arrow 29 for further processing. Continued rotation of belt 10 by drive roll 22 takes it past station 50 where the belt is neutralized and cleaned by conventional means in preparation for recharging as the belt is driven around drive roll 22. Operating in this manner, Xeromorph piezoactive photoreceptor belt 10 is self-biased due to the piezoelectric effect of the PVFD material for the purposes of both charging and transfer.

It should now be appreciated that an improved, environmentally green, low cost, piezographic imaging process and apparatus have been disclosed that eliminates ozone producing charging and transfer devices and is less costly that present imaging processes since costly high voltage power supplies are not needed. The improved piezographic imaging process uses a PVFD film in the photoreceptor structure above a grounded electrode which, when flexed around rolls produces the voltages for charging and transfer.

While the invention has been described with reference to the structure herein disclosed, it is not confined to the details as set forth and is intended to cover any modifications and changes that may come within the scope of the following claims.

What is claimed is:

1. An apparatus for placing images of page image information onto copy sheets, comprising:

an image receiving member, said image receiving member comprising a photoconductive belt positioned on top of a PVFD material with the PVFD material being supported on a conductive electrode, said photoconductive belt being supported by spaced apart rollers; and wherein said photoconductive belt is charged responsive to flexure of said PVDF material as it is bent around said spaced apart rollers;

an exposure device adapted to place images onto said photoconductive belt by discharging said photoconductive belt in imagewise configuration;

a development device adapted to develop the page image information on said photoconductive belt; and a transfer station, including one of said spaced apart rollers, and a biased contact member, in combination with and responsive to flexure of said PVDF material generating a transfer field, adapted to transfer developed page image information from said photoconductive belt onto copy sheet.

2. A process for placing images of page image information onto copy sheets, comprising the steps of:

providing a photoconductive belt with a piezoelectrically active layer therein, and supporting said photoconductive belt on a drive roll and an idler roll;

applying a first charge to said photoconductive belt by bending said photoconductive belt around said drive roll, whereby flexure of a piezoelectrically active layer therein generates an electric field suitable for said first charge;

discharging said photoconductive belt to thereby form images of page image information thereon;

developing the page image information on said photoconductive belt;

bending said photoconductive belt around said idler roll to provide a second charge to said photoconductive belt whereby flexure of a piezoelectrically active layer therein generates an electric field suitable for said first charge; and utilizing said second charge on said photoconductive belt to transfer the page image information from said photoconductive belt to a copy sheet.

* * * * *